United States Patent [19]

Brush, Jr.

[11] Patent Number: 4,619,487

[45] Date of Patent: Oct. 28, 1986

[54] FLAT CABLE CONNECTOR WITH GROUNDING CLIP

[75] Inventor: Robert W. Brush, Jr., North Brunswick, N.J.

[73] Assignee: Thomas & Betts Corporation, Raritan, N.J.

[21] Appl. No.: 655,971

[22] Filed: Sep. 28, 1984

[51] Int. Cl.[4] ..... H01R 13/658; H01R 9/07

[52] U.S. Cl. ..... 339/14 R; 339/143 R; 339/176 MF

[58] Field of Search ..... 339/14 R, 17 F, 176 MF, 339/143 R

[56] References Cited

U.S. PATENT DOCUMENTS

| | | | |
|---|---|---|---|
| 2,762,025 | 9/1956 | Melcher | 339/143 |
| 3,448,430 | 6/1969 | Kelly | 339/143 |
| 3,564,117 | 2/1971 | Scheffler et al. | 174/89 |
| 3,744,128 | 7/1973 | Fisher et al. | 339/143 R X |
| 3,985,950 | 10/1976 | Maltz | 174/88 |
| 3,992,773 | 11/1976 | Duffner et al. | 339/143 R X |
| 4,090,768 | 5/1978 | Tregoning | 339/143 |
| 4,179,178 | 12/1979 | Bachman | 339/111 |
| 4,273,405 | 6/1981 | Law | 339/94 |
| 4,420,201 | 12/1983 | Stephenson | 339/143 R X |
| 4,437,724 | 3/1984 | Volka | 339/143 |
| 4,457,576 | 7/1984 | Cosmos et al. | 339/143 |
| 4,458,967 | 7/1984 | King et al. | 339/14 |

FOREIGN PATENT DOCUMENTS

| | | |
|---|---|---|
| 839212 | 5/1952 | Fed. Rep. of Germany . |
| 1298877 | 12/1962 | France . |
| 126161 | 3/1959 | U.S.S.R. . |

*Primary Examiner*—Gil Weidenfeld
*Assistant Examiner*—Steven C. Bishop
*Attorney, Agent, or Firm*—Robert M. Rodrick; Salvatore J. Abbruzzese

[57] ABSTRACT

An electrical connector for terminating shielded flat multi-conductor cable. The connector includes a housing having a metal connector shell. A conductive spring clip is provided which contacts the metallic shielding of the cable and the metal shell of the connector housing. The conductive spring clip provides shielding for the cable at its terminated end.

8 Claims, 4 Drawing Figures

FIG. 1
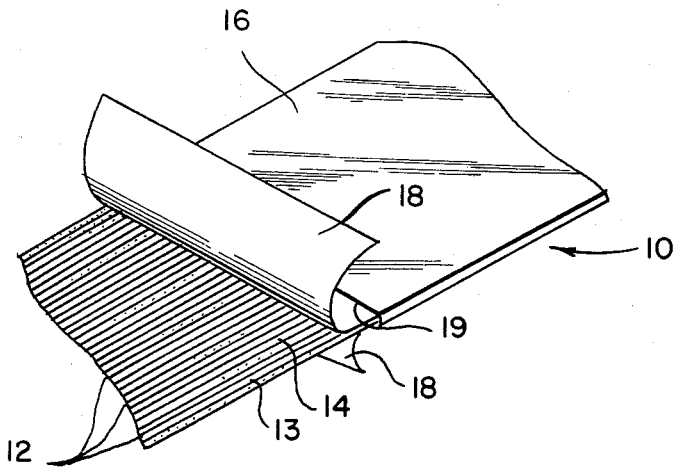
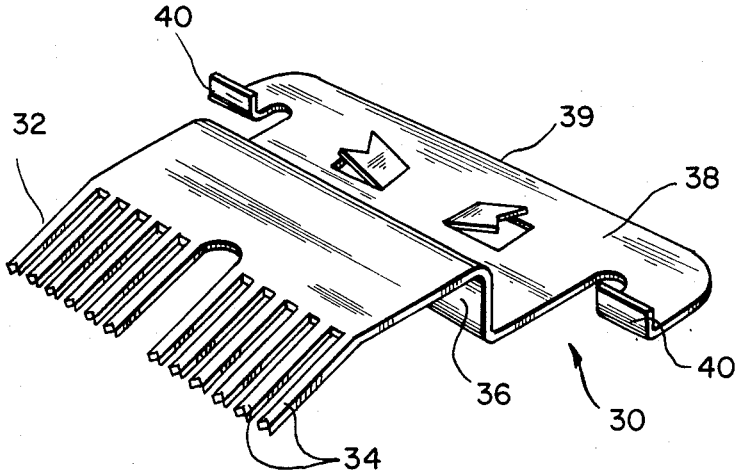
FIG. 3

FLAT CABLE CONNECTOR WITH GROUNDING CLIP

FIELD OF THE INVENTION

The present invention relates generally to an electrical cable connector providing a direct conductive path between the shield of an electrical cable and the shell of the connector and more particularly to a shield link between the cable and the connector which reduces electromagnetic and radio frequency interferences.

BACKGROUND OF THE INVENTION

In the electronic interconnection field, it is well-known that signal transmission through electrical cable may be adversely affected by electromagnetic and radio frequency interferences (EMI and RFI). Electrical cable, especially that formed in a flat array, known as ribbon cable, typically includes a metallic shield over the length thereof which provides a conductive path to drain such external interferences, thus reducing its adverse impact on signal transmission. While effectively providing a shield from EMI and RFI along the cable length, upon termination of the cable with an appropriate electrical connector, the shield is striped back at one end to expose the conductors for termination. Thus at the interconnections, the cable may not be adequately shielded.

Techniques are known which provide shielding of the cable and the connector at the points of interconnection. These techniques include surrounding the electrical connector with a metal housing, commonly referred to as a back-shell, and connecting the housing to the shield of the cable. Thus, the back shell will be at the same electrical potential as the cable shield. Since the back shell surrounds the connector, the point of interconnection will be shielded by the back shell. Often, the front face of the connector itself is housed in a metal shell which is used as ground for the contacts which extend therethrough. Thus it becomes desirous to connect the metal shell of the connector to the metal back shell to assure complete shielding.

In order to assure complete continuity between the shield of the cable and the shell of the connector, each contact point must be reliably maintained. Shielded connectors known presently in the art, provide a metallic spring clip which is inserted between the cable shield and the back shell. The spring clip maintains electrical contact between the shield and the back shell. A second similar spring clip is also used between the back shell and the shell of the connector.

As can be seen, this type of interconnection requires additional multiple ground connection interfaces, parts not normally required for transmission of electrical signals. Further, the parts should be designed to close tolerances to assure proper functioning. The back shell, being part of the conductive shielding part, would be constructed of highly conductive metal. It is apparent that shielding consideration significantly increases the cost of cable interconnection. The use of less costly materials, such as plastic or low-conductivity metal for back shells can not be implemented without compromising on shielding capabilities.

SUMMARY OF THE INVENTION

It is an object of the present invention to provide shielding from electromagnetic and radio frequency interferences for a signal cable connector.

It is a further object to provide a conductive element in an electrical cable connector which provides electrical continuity between the shield of a signal cable and the conductive shell of the connector.

The present invention contemplates providing a conductive element which spans the connector housing and provides for electrical continuity between the cable shield and the shell of the connector. The conductive element serves as an EMI and RFI drain from the cable shield and the backshell.

In a preferred embodiment of the present invention, an electrical connector for flat signal cable is shown. The connector includes an insulative housing for supporting the cable and a plurality of contacts for electrical engagement with the cable conductors. The housing is supported in a conductive shell. A conductive element is further provided which has a first extent for engagement with the cable shield and a second extent in engagement with the conductive shell of the connector. Thus, an electrical path is established between the shield of the cable and the shell of the connector.

BRIEF DESCRIPTION OF THE DRAWINGS

FIG. 1 shows a flat multiconductor shielded cable assembly.

FIG. 3 shows in exploded perspective view the cable assembly of FIG. 1 terminated with a connection assembly of the present invention.

DETAILED DESCRIPTION OF THE PREFERRED EMBODIMENT

Figure 2:
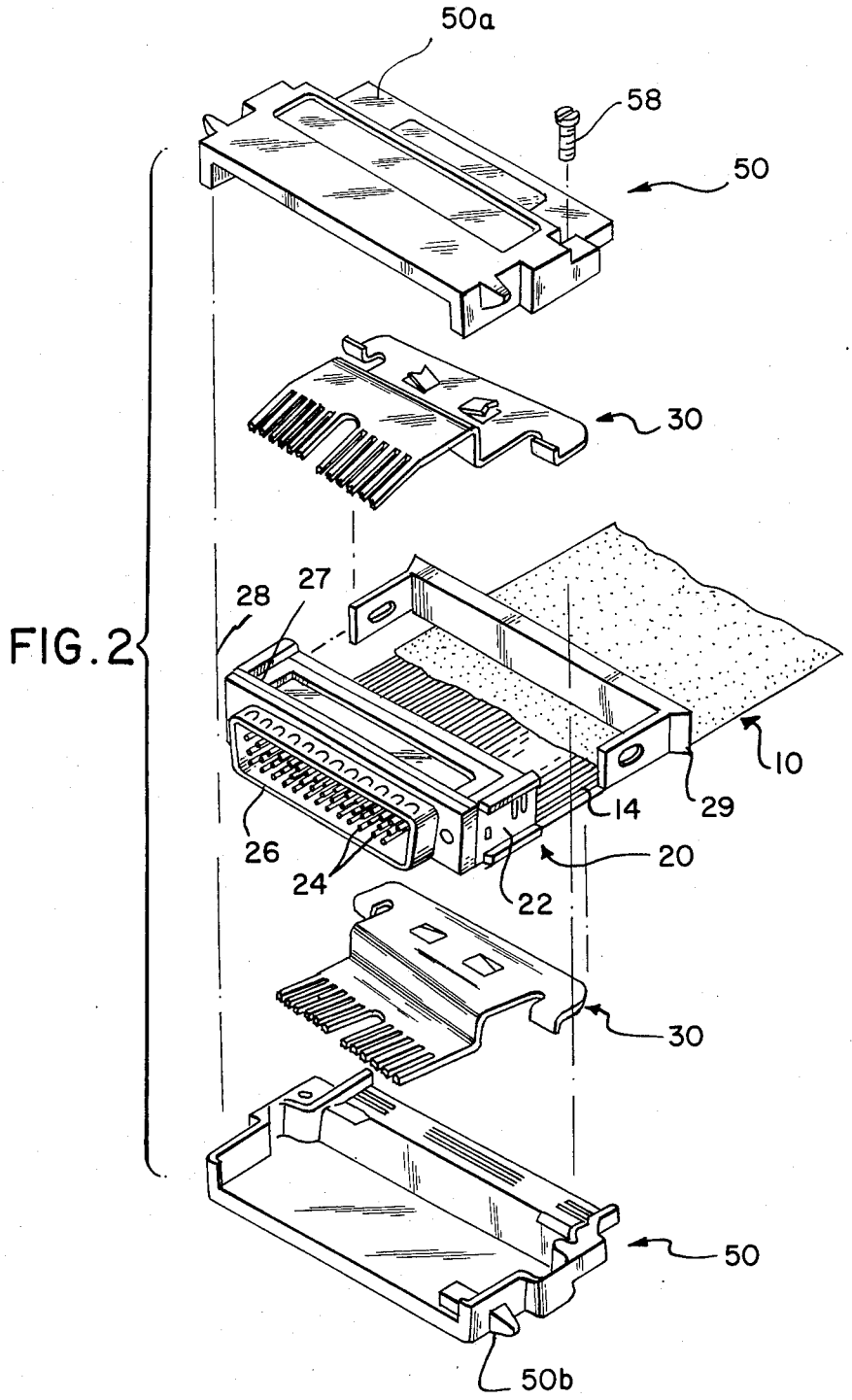
FIG. 2 is a perspective showing of the conductive spring clip of the present invention.

A length of cable assembly 10 is shown in FIG. 1 which comprises plural transversely spaced electrical conductors 12 which are aligned in a flat array and surrounded in an insulative casing 13 to form a flat cable 14. As illustrated herein the cable 14 is a 50-conductor cable, however cables having other numbers of conductors may also be employed. An outer insulative jacket 16, typically formed of flexible vinyl or other suitable plastic surrounds the flat cable 14. Positioned between jacket 16 and flat cable 14 on each side thereof is a metallic shield 18. Shield 18 is formed of a layer of thinly formed metal such as aluminum and extends on either side of flat cable 14 along the length of cable assembly 10. In FIG. 1 for illustrative purposes, metallic shield 18 is shown extending beyond a trimmed transverse edge 19 of cable jacket 16, however in practice as will be described in detail hereinbelow, each metal shield 18 is trimmed along edge 19.

Referring now to FIG. 2, cable assembly 10 is shown terminated in an electrical connector 20. Electrical connector 20 is a conventional flat cable connector having an insulative housing 22 which supports therein a plurality of electrical contacts 24 for connection to the conductors 12 of flat cable 14. Connector 20 may be of the type shown and described in U.S. Pat. No. 4,437,723 issued Mar. 20, 1984, and assigned to the assignee of the present invention. Connector 20 shown by way of the preferred embodiment is of the 'D' connector variety having a front connection face 26, which surrounds the extending portions of contacts 24. The extending contacts 24 are arranged in 3 successive rows of 17, 16 and 17 contacts each. Surrounding the front face 26 of connector 20 is a metal connector shell 28 formed in a 'D' configuration. Connector shell 28 facilitates interconnection of connector 20 and provides shield continuity from cable assembly 10 as will be described in detail hereinafter. The metal connector shell 28 is also used for ground connection as a drain for RFI or EMI. Thus, when connected to the shield 18 of cable assembly 10, cable noise or other interference will be drained to ground. The termination of flat cable 14 to connector 20 may be accomplished in a manner which is conventional in the art. A strain relief device 29, also known in the art, secures the flat cable 14 to connector 20.

As set forth hereinabove, it is desirous to maintain electrical continuity between the metallic shield 18 (FIG. 1) of cable assembly 10 and the metal connector shell 28. A pair of conductive spring clips 30 are provided which are disposed to surround the stripped extent of flat cable 14 and provide electrical continuity between shreld 18 and connector shell 28.

Shown in detail in FIG. 3, spring clip 30 is substantially a flat, formed metallic member preferably made of copper alloy or other highly conductive material. Clip 30 has a first end portion 32 which includes a plurality of parallel extending fingers 34, which upon assembly bear against and contact opposed lateral surfaces 27 (FIG. 2) of metal connector shell 28. Plural fingers 34 are provided so that plural separate parallel paths of electrical contact can be established between the clip 30 and metal connector shell 28 (FIG. 2). Plural parallel electrical paths are desired as the resulting impedance will be significantly less than would be with a single path of contact.

Figure 4:
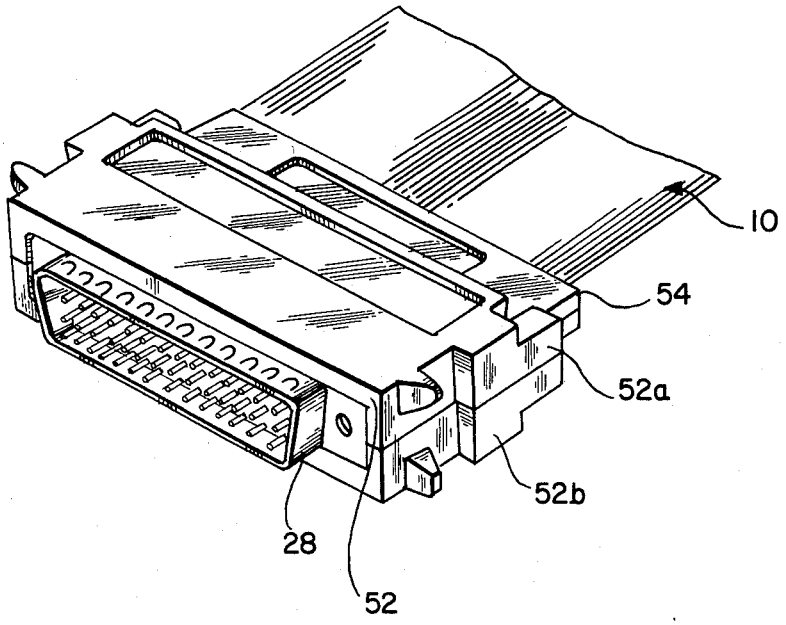
FIG. 4 is a perspective view of the fully assembled connector assembly.

The spring clip 30 includes a bent and formed central portion 36 which is adapted to accommodate connector 20 in assembled condition as shown in FIG. 4. The opposite end 38 of clip 30 includes a shield engaging end portion 39. The end portion 39 is inserted into the cable jacket 16 (not shown) between the jacket 16 and shield 18 making intimate electrical and mechanical contact with shield 18. The end portion 39 is progressively inserted into jacket 16 with upturned protrusions 40, serving as stop surfaces to engage the end 19 of jacket 16 to prevent further insertion. End portion 39 also includes a pair of oppositely directed lances 41 which are struck up from a central location of end portion 39. Lances 41, which are transversely aligned with protrusions 40, provide for electrical engagement with the metal back shell as will be described in greater detail hereinbelow.

Referring again to FIG. 2, a back shell 50 is shown. Back shell 50 is an outer housing which encloses and supports connector 20 and the terminated extent of cable assembly 10. In the present embodiment back shell 50 is a metallic member comprising a pair of mating halves 50*a* and 50*b*. Each half has a front face 52 (FIG. 4) which provides access to the front face 26 of connector 20. Upon assembly, the back shell 50 supports and secures the fingers 34 of spring clip 30 in intimate contact against metal connector shell 28, establishing electrical contact therebetween. A rear portion 54 of each half 50*a* and 50*b* confines therebetween the extending portion 39 of cable assembly 10 and secures end 38 of spring clip 30 in contact with shield 18. The mating halves 50*a* and 50*b* may be suitably secured as is conventional in the art, for example by the use of self-tapping screws 59 placed on either side thereof.

In the present illustrative embodiment back shell 50 is formed of a conductive metal. When fully assembled (FIG. 4) the lances 41 of spring clip 30 (FIG. 3) will contact the undersurface of each half 50*a* and 50*b*. Electrical continuity will be established between the spring clip 30 and metal back shell 50. As the front face 52 of back shell 50 (FIG. 4) is in intimate contact with the metal connector shell 28 of connector 20, electrical contact will also be established therebetween. Thus an electrical shielding path will be provided between the shield 18 of cable assembly 10 and the metal shell 28 of connector 20 through metal back shell 50. However, the present invention provides a direct path from the shield 18 to the metal connector shell 28 without need to place the back shell 50 in the conductive path. As above described, the spring clip 30 provides such direct electrical connection between shield 18 and metal shell 28. Thus, shielding for EMI and RFI may still be maintained where the back shell is formed of a non-conductive material such as plastic.

Various other modifications to the foregoing disclosed embodiment will be evident to those skilled in the art. Thus, the particularly described preferred embodiment is intended to be illustrative and not limited thereto. The true scope of the invention is set forth in the following claims.

I claim:

1. An electrical connector for terminating flat electrical cable having a plurality of conductors, an overlying conductive shield and an outer insulative jacket, said connector comprising:

an insulative housing for accommodating said cable;

a plurality of electrical contacts supported in said housing for electrical engagement with said conductors of said cable;

a conductive shell supporting said housing; and a conductive element having a first extent for engagement with the conductive shield of said cable and a second extent engageable with the conductive shell for providing electrical continuity between said shield and said shell, said second extent of said conductive element further including a plurality of integrally formed fingers extending into contact with said shell, said fingers providing plural parallel electrical paths between said conductive element and said shell.

2. A connector in accordance with claim 1 wherein said conductive element is formed to accommodate said housing.

3. A connector in accordance with claim 2 further comprising:

a back shell for supporting said housing, said conductive shell and said conductive element.

4. A connector in accordance with claim 2 wherein said conductive element includes a centrally disposed spring element for contact with said back shell.

5. A connector in accordance with claim 4 wherein said back shell is conductive and said spring element provides electrical continuity between said conductive element and said back shell.

6. An electrical connector for terminating flat electrical cable having a plurality of conductors, an overlying conductive shield and an outer insulative jacket, said connector comprising:

an insulative housing for accommodating said cable;

a plurality of electrical contacts supported in said housing for electrical engagement with said conductors of said cable;

a conductive shell supporting said housing;

a back shell for supporting said housing, and said conductive shell; and a conductive element having a first extent for engagement with the conductive shield of said cable and a second extent engagable with the conductive shell for providing electrical continuity between said shield and said shell, said conductive element including a centrally disposed spring element for contact with said back shell.

7. A connector in accordance with claim 6 wherein said back shell is conductive and said spring element provides electrical continuity between said conductive element and said back shell.

8. A connector in accordance with claim 6 wherein said second extent of said conductive element further includes a plurality of integrally formed fingers extending into contact with said shell, said fingers providing plural parallel electrical paths between said conductive element and said shell.

* * * * *